US008388310B1

(12) United States Patent
Diakunchak

(10) Patent No.: US 8,388,310 B1
(45) Date of Patent: Mar. 5, 2013

(54) TURBINE DISC SEALING ASSEMBLY

(75) Inventor: Ihor S. Diakunchak, Mississauga (CA)

(73) Assignee: Siemens Energy, Inc., Orlando, FL (US)

( * ) Notice: Subject to any disclaimer, the term of this patent is extended or adjusted under 35 U.S.C. 154(b) by 1436 days.

(21) Appl. No.: 12/022,302

(22) Filed: Jan. 30, 2008

(51) Int. Cl.
*F01D 25/24* (2006.01)
*F04D 3/00* (2006.01)
*F04D 19/00* (2006.01)

(52) U.S. Cl. ..... 415/173.7; 415/174.5

(58) Field of Classification Search ..... 415/135, 415/173.7, 177, 200; 277/412, 417–419, 277/530
See application file for complete search history.

(56) References Cited

U.S. PATENT DOCUMENTS 1,708,044 A * 4/1929 Baumann ..... 277/418
4,425,079 A 1/1984 Speak et al.
5,358,374 A 10/1994 Correia et al.
5,503,528 A 4/1996 Glezer et al.
5,967,745 A 10/1999 Tomita et al.
6,077,035 A 6/2000 Walters et al.
6,155,574 A * 12/2000 Borgstrom et al. ..... 277/419
6,220,814 B1 4/2001 Brushwood et al.
6,506,016 B1 1/2003 Wang
6,854,736 B2 2/2005 Paprotna
6,899,520 B2 5/2005 Habedank et al.
7,059,829 B2 6/2006 Garner
7,134,843 B2 * 11/2006 Lardellier ..... 416/204 R
7,172,388 B2 2/2007 Synnott
7,234,918 B2 * 6/2007 Brillert et al. ..... 415/173.5
7,246,995 B2 7/2007 Zborovsky
7,540,709 B1 * 6/2009 Ebert ..... 415/173.7
2007/0059163 A1 3/2007 Tiemann

* cited by examiner

*Primary Examiner* — Edward Look
*Assistant Examiner* — Woody A Lee, Jr.

(57) ABSTRACT

A disc seal assembly for use in a turbine engine. The disc seal assembly includes a plurality of outwardly extending sealing flange members that define a plurality of fluid pockets. The sealing flange members define a labyrinth flow path therebetween to limit leakage between a hot gas path and a disc cavity in the turbine engine.

19 Claims, 3 Drawing Sheets

TURBINE DISC SEALING ASSEMBLY

This invention was made with U.S. Government support under Contract Number DE-FC26-05NT42644 awarded by the U.S. Department of Energy. The U.S. Government has certain rights to this invention.

FIELD OF THE INVENTION

The present invention relates generally to a disc seal assembly for use in a turbine engine, and more particularly, to a disc seal assembly including a plurality of sealing flange members that define a labyrinth flow path to limit leakage between a disc cavity and a hot gas passage in the turbine engine.

BACKGROUND OF THE INVENTION

In multistage rotary machines used for energy conversion for example, a fluid is used to produce rotational motion. In a gas turbine engine, for example, a gas is compressed in a compressor and mixed with a fuel source in a combustor. The combination of gas and fuel is then ignited for generating combustion gases (hot gas) that are directed to turbine stage (s) to produce rotational motion. Both the turbine stage(s) and the compressor have stationary or non-rotary components, such as vanes, for example, that cooperate with rotatable components, such as rotor blades, for example, for compressing and expanding the operational gases. Many components within the machines must be cooled by cooling air to prevent the components from overheating.

Cooling air and hot gas leakage between a hot gas path and a disc cavity in the machines reduces performance and efficiency. Cooling air leakage from the disc cavities into the hot gas path in airfoil channels can disrupt the flow of the hot gas and increase heat losses. Further, as more cooling air is leaked into the hot gas path, the higher the primary zone temperature in the combustor must be to achieve the required engine firing temperature. Additionally, hot gas leakage into the disc cavities yields higher disc and blade root temperatures and may result in reduced performance and reduced service life and/or failure of the components in the disc cavities.

In view of higher pressure ratios and higher engine firing temperatures implemented in modern machines, it is increasingly important to limit leakage between the hot gas path and the disc cavity in the machines to maximize performance and efficiency thereof.

In view of the foregoing considerations it would be desirable to provide a seal arrangement for use in a rotary machine, whereby the placement and configuration of sealing flanges in the arrangement limits leakage between the hot gas path and the disc cavity to thereby improve performance and efficiency of the rotary machine.

SUMMARY OF THE INVENTION

In accordance with a first aspect of the present invention, a seal assembly is provided for limiting gas leakage between a hot gas path and a disc cavity in a turbine engine comprising a plurality of stages, each stage comprising a plurality of stationary components connected by an annular inner shroud and a rotating disc supporting a plurality of blades. The seal assembly comprises a wing member extending axially from a side of the disc toward a radial surface of the annular inner shroud. The wing member includes an inner side and an outer side and a first wing flange extending radially outwardly from the outer side of the wing member toward an axial surface of the inner shroud. A first shroud flange extends radially inwardly from the axial surface of the inner shroud toward the outer side of the wing member to form, with the first wing flange, a labyrinth path between the hot gas path and the disc cavity.

In accordance with a second aspect of the present invention, a seal assembly is provided for limiting gas leakage between a hot gas path and a disc cavity in a turbine engine comprising a plurality of stages, each stage comprising a plurality of stationary components connected by an annular inner shroud and a rotating disc supporting a plurality of blades. The seal assembly comprises a wing member extending axially from a side of the disc toward a radial surface of the annular inner shroud. The wing member includes an inner side and an outer side, and a first wing flange extending radially outwardly from the outer side of the wing member toward an axial surface of the inner shroud. A second wing flange extends radially inwardly from the inner side of the wing member opposite from the first wing flange. A first shroud flange extends radially inwardly from the axial surface of the inner shroud toward the outer side of the wing member to form, with the first wing flange, a labyrinth path between the hot gas path and the disc cavity.

In accordance with a third aspect of the present invention a seal assembly is provided for limiting gas leakage between a hot gas path and a disc cavity in a turbine engine comprising a plurality of stages, each stage comprising a plurality of stationary components connected by an annular inner shroud and a rotating disc supporting a plurality of blades. The seal assembly comprises a wing member extending axially from a side of the disc toward a radial surface of the annular inner shroud. The wing member includes an inner side and an outer side, and a first wing flange extending radially outwardly from the outer side of the wing member toward an axial surface of the inner shroud. The first wing flange is curved extending in the radial direction and having a concave side facing the disc. A second wing flange extends radially inwardly from the inner side of the wing member opposite from the first wing flange. The second wing flange is curved extending in the radial direction and having a concave side facing the disc. A first shroud flange extends radially inwardly from the axial surface of the inner shroud toward the outer side of the wing member to form, with the first wing flange, a labyrinth path between the hot gas path and the disc cavity, wherein the first shroud flange includes a lip member extending axially from a distal end of the first shroud flange toward the first wing flange. A second shroud flange extends axially from the radial surface of the inner shroud toward the disc at a radial location generally between the first wing flange and the second wing flange.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
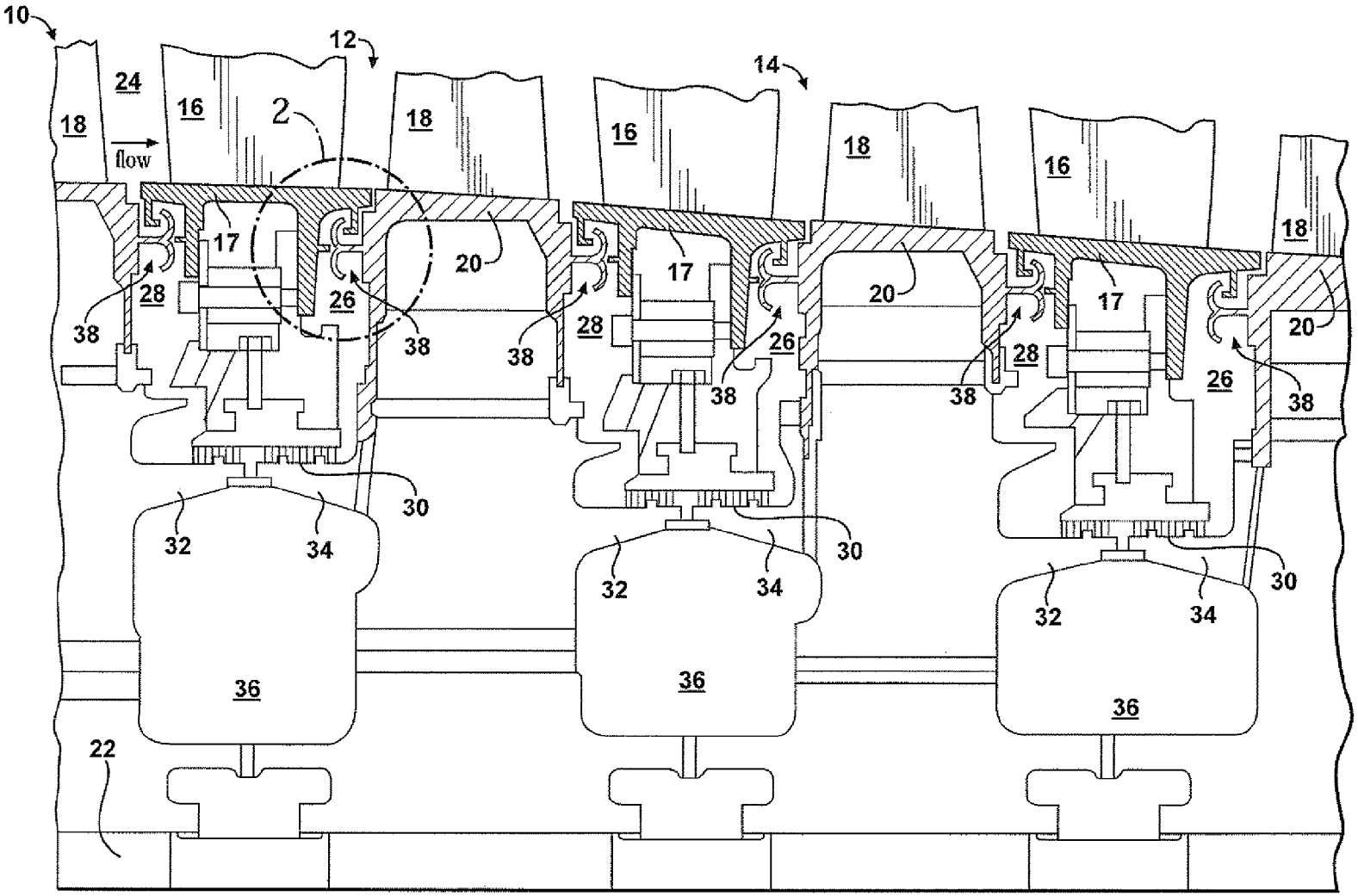
FIG. 1 is a diagrammatic sectional view of a portion of a gas turbine engine including a disc seal assembly in accordance with the invention.

Referring to FIG. 1, a portion of a turbine engine 10 is illustrated diagrammatically including adjoining stages 12, 14, each stage comprising an array of stationary components, illustrated herein as vanes 16, supported on inner shrouds 17, and an array of rotating blades 18 supported on platforms 40 mounted to rotor discs 20. The vanes 16 and the blades 18 are positioned circumferentially within the engine 10 with alternating vanes 16 and blades 18 located in the axial direction of the engine 10. The rotor discs 20 are secured to adjacent discs 20 with spindle bolts 22. The vanes 16 and the blades 18 extend into an annular gas passage 24, and hot gases directed through the gas passage 24 flow past the vanes 16 and the blades 18 to remaining rotating elements.

First disc cavities 26 and second disc cavities 28 are illustrated located radially inwardly from the gas passage 24. Purge air is provided from cooling gas passing through internal passages (not shown) in the vanes 16 and inner shrouds 17 to the disc cavities 26, 28 to cool the blades 18. The purge air also provides a pressure balance against the pressure of the hot gases flowing in the gas passage 24 to counteract a flow of the hot gases into the disc cavities 26, 28. In addition, interstage seals comprising labyrinth seals 30 may be supported at the radially inner side of the inner shrouds 17 and are engaged with surfaces defined on paired annular disc arms 32, 34 extending axially from opposed portions of adjoining discs 20. An annular cooling cavity 36 is formed between the opposed portions of adjoining discs 20 on an inner side of the paired annular disc arms 32, 34. The annular cooling cavity 36 receives cooling air passing through disc passages (not shown) to cool the discs 20.

Figure 2:
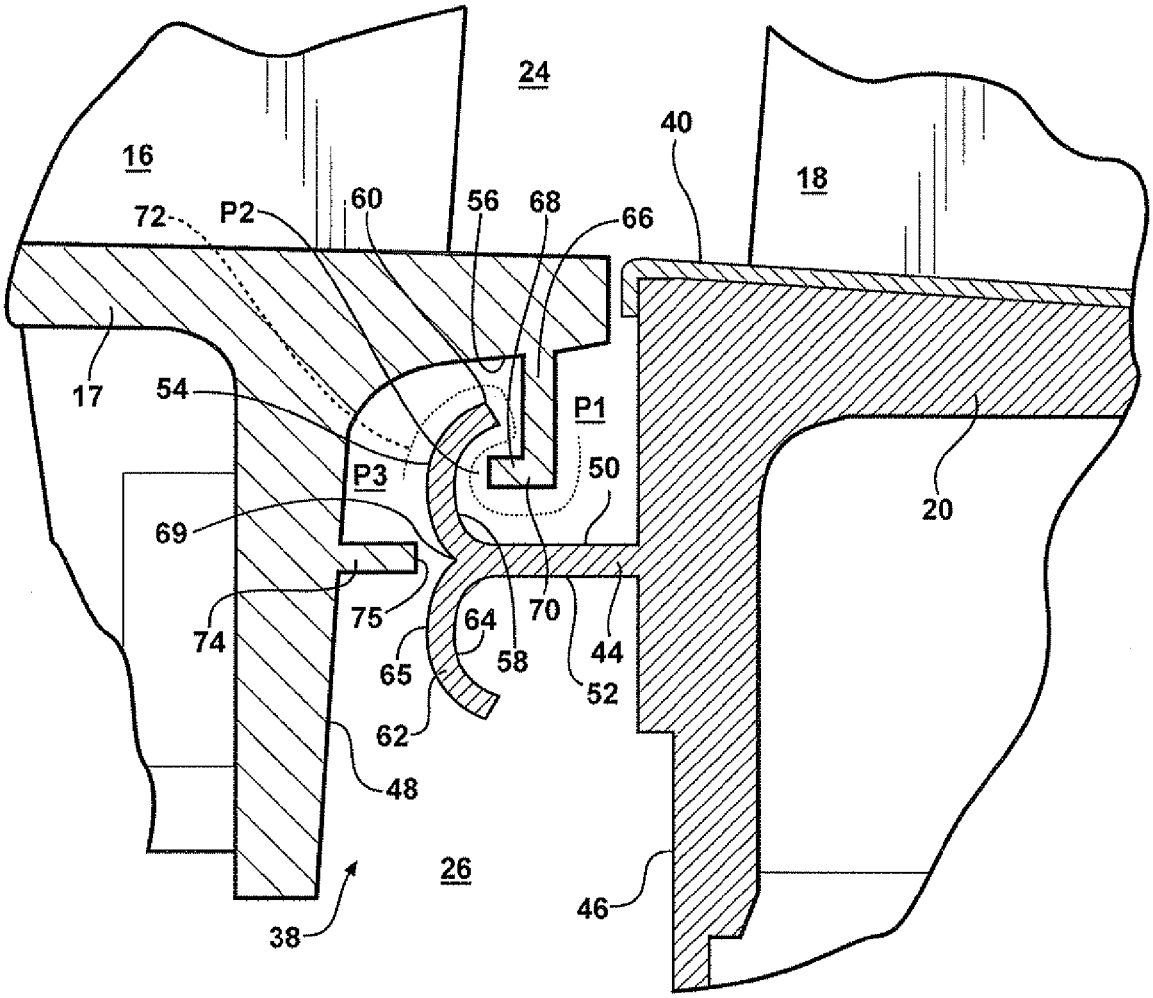
FIG. 2 is an enlarged sectional view of the disc seal assembly illustrated in FIG. 1.

Structure on the discs 20 and the inner shrouds 17 cooperate to form annular disc sealing assemblies 38 between the gas passage 24 and the disc cavities 26, 28, as more clearly shown in FIG. 2. For exemplary purposes, only one disc sealing assembly 38 formed between the gas passage 24 and the first disc cavity 26 will be described. However, it is understood that the other disc sealing assemblies 38 formed between the gas passage 24 and other disc cavities 26, 28 within the engine 10 are generally identical to or are substantially mirror images of the disc sealing assembly 38 described.

FIG. 2 shows an enlarged view illustrating the disc sealing assembly 38. A wing member 44 extends axially from a first side 46 of the disc 20 toward a radial surface 48 of the inner shroud 17. In the embodiment shown, the wing member 44 is formed from a high temperature alloy, such as for example an INCONEL® alloy (INCONEL® is a registered trademark of Special Metals Corporation), although any suitable material may be used to form the wing member 44 as desired.

Although only a single wing member 44 is shown, it should be understood that a plurality of wing members 44 may be employed to form the disc sealing assembly 38 as desired. If multiple wing members 44 are used to form the disc sealing assembly 38, the wing members 44 are preferably located adjacent to each other extending circumferentially about the disc 20, and the wing members 44 may include cooperating ramped or angled overlapping edges (not shown) to reduce spacing between adjacent wing members 44 and provide a sealing interface for restricting passage of gases between adjacent wing members 44.

The wing member 44 includes an outer side 50 facing radially outwardly from the wing member 44 and an inner side 52 facing radially inwardly from the wing member 44. The outer side 50 and inner side 52 may be generally arcuate shaped in the circumferential direction to substantially correspond to the arcuate shape of the disc 20 when viewed axially.

A first wing flange 54 extends radially outwardly from the outer side 50 of the wing member 44 toward an axial surface 56 of the inner shroud 17. The axial surface 56 of the inner shroud 17 is located adjacent to and extends in a transverse direction from the radial surface 48 of the inner shroud 17. In the embodiment shown, the first wing flange 54 is formed from a high temperature alloy, such as an INCONEL® alloy, for example, although any suitable material may be used to form the first wing flange 54 as desired. The first wing flange 54 may be arcuate shaped in the circumferential direction to substantially correspond to the arcuate shape of the disc 20 when viewed axially. In addition, the first wing flange 54 may be curved in the radial direction and include a concave side 58 facing the disc 20. A distal end 60 of the first wing flange 54 is located adjacent to the axial surface 56 of the inner shroud 17.

The inner shroud 17 includes a first shroud flange 66 that extends radially inwardly from the axial surface 56 of the inner shroud 17 toward a location adjacent the outer side 50 of the wing member 44. The first shroud flange 66 may be arcuate shaped in the circumferential direction to substantially correspond to the arcuate shape of the inner shroud 17 when viewed axially. In the embodiment shown, the first shroud flange 66 is located at an axial location between the first wing flange 54 and the disc 20. The first shroud flange 66 includes a lip member 68 that extends axially from a distal end 70 of the first shroud flange 66 toward the first wing flange 54. A first fluid pocket P1 is formed between the first shroud flange 66 and the disc 20. A second fluid pocket P2 is formed between the first wing flange 54 and the first shroud flange 66.

A second wing flange 62 extends radially inwardly from the inner side 52 of the wing member 44. In the embodiment shown, the second wing flange 62 is formed from a high temperature alloy, such as an INCONEL® alloy, for example, although any suitable material may be used to form the second wing flange 62 as desired. The second wing flange 62 may be arcuate shaped in the circumferential direction to substantially correspond to the arcuate shape of the disc 20 when viewed axially. In addition, the second wing flange 62 may be curved in the radial direction and include a concave side 64 facing the disc 20.

It should be noted that the surfaces of the wing member 44, including the surfaces of the first and second wing flanges 54, 62, may be hardened or coated with a hard material in order to prevent or reduce abrasion and wear of these surfaces in the event that rubbing contact occurs with adjacent stationary surfaces.

During operation of the engine 10, the cooling air in the disc cavity 26 is pumped radially outwardly by the rotation of the disc 20. The curved configuration of the second wing flange 62 acts as an aerodynamic break and deflects the outward flowing disc boundary layer flow of air away from the disc 20 and forcing it to turn 180 degrees to pass around the edge of the second wing flange 62. That is, the air of the boundary layer flow must flow in a direction radially inwardly toward the rotational axis of the disc 20 and then turn 180 degrees around the edge of the second wing flange 62 in order to flow radially outwardly past the wing member 44 along an outer convex side 65 of the second wing flange 62. A limited gap or passage area is defined between the distal end 75 of the second shroud flange 74 and the wing flange midpoint 69 which operates to further restrict radial outward flow of cooling air from the disc cavity 26 into the third fluid pocket P3.

Once cooling air or gas passes into the third fluid pocket P3, it must follow a tortuous path defined by the labyrinth path 72 in order to escape into the gas passage 24. Specifically, gas located within the third fluid pocket P3 must pass around the distal end 60 of the first wing flange 54 and turn 180 degrees to enter the second fluid pocket P2, moving in a direction counter to the centrifugal outward pumping forces associated with the fluid boundary layer of the first wing flange 54. Gas in the second fluid pocket P2 must again turn 180 degrees to pass out of the second fluid pocket P2 and into the first fluid pocket P1 and the gas passage 24. It should be noted that the lip 68 forces gas in the second fluid pocket P2 to move toward an outwardly moving boundary layer associated with the concave side 58 of the first wing flange 54 to further counteract movement of gas from the second fluid pocket P2 toward the gas passage 24. It should also be understood that the restricted passages defined adjacent the distal end 60 of the first wing flange 54 and adjacent the distal end 70 of the first shroud flange 66 further act to restrict passage of gas through the labyrinth path 72 to the gas passage 24.

In addition to restricting a flow of cooling air into the gas passage 24, the sealing assembly 38 also provides a tortuous labyrinth path 72 that hot gases from the gas passage 24 must overcome in order to enter the disc cavity 26. In addition, a pressure rise associated with the restricted seal clearances defined at the distal ends 60, 70, 75 of the first wing flange 54 and the first and second shroud flanges 66, 74, respectively, further counteracts movement of the hot gases into the disc cavity 26.

Figure 3:
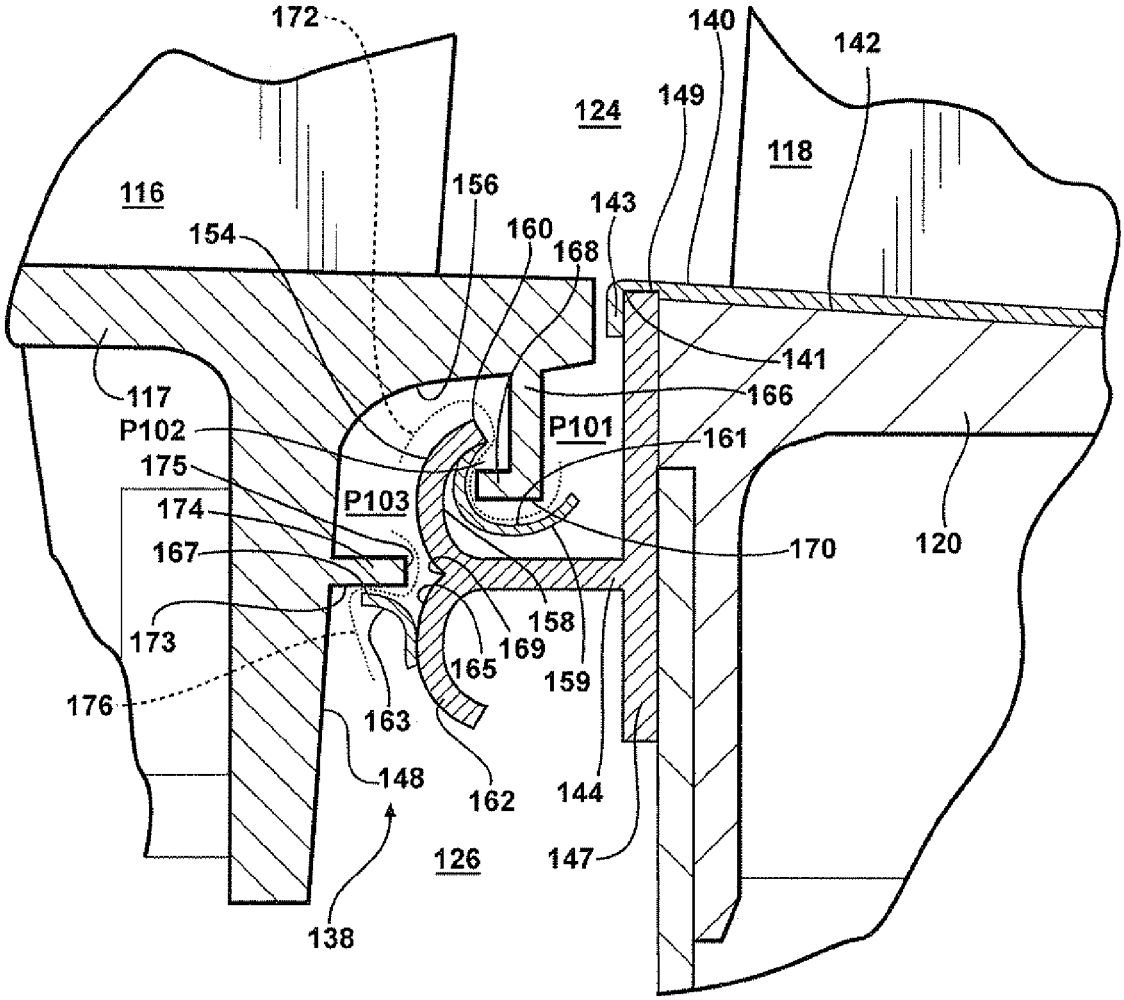
FIG. 3 is an enlarged sectional view of a disc seal assembly in accordance with another embodiment of the present invention.

FIG. 3 shows an enlarged view illustrating a disc sealing assembly 138 in accordance with another embodiment of the invention, wherein corresponding structure to that described above with reference to FIGS. 1 and 2 is identified by the same reference increased by 100. With the exception of a cover plate 147, a first flexible seal 159, a second flexible seal 163 and the particular structure of a portion of the a blade platform 140 associated with each of the blades 118, the disc sealing assembly 138 is substantially identical to the disc sealing assembly 38 discussed above with reference to FIGS. 1 and 2. Accordingly, only these components and their associated functions will now be described.

The blade platform 140 supports a blade 118 thereon and includes a circumferentially extending annular groove 141 located adjacent an outer lip 143 thereof. The cover plate 147 may be provided as a cover for the axial end of the blade root of one or more blades 118 and is shown as including a radial outer edge 149. The radial outer edge 149 is received in the annular groove 141 of the blade platform 140 and the cover plate 147 may be further mechanically secured in place, such as by clamping, peening, screwing, or other mechanical securing means, for example. It should be understood that a plurality of cover plates 147 may be provided around the circumference of the disc 120, and that each cover plate 147 may include one or more wing members 144 to form the disc sealing assemblies 138. The wing member 144 extends from the cover plate 147 toward a radial surface 148 of an inner shroud 117.

The inner shroud 17 also includes a second shroud flange 74 that extends axially from the radial surface 48 of the inner shroud 17 toward the wing member 44. The second shroud flange 74 may be arcuate shaped in the circumferential direction to substantially correspond to the arcuate shape of the inner shroud 17 when viewed axially. In the embodiment shown, the second shroud flange 74 is generally radially aligned with the wing member 44, i.e., the second shroud flange 74 and the wing member 44 are located at generally the same radially location such that they are generally equidistant from a central axis of the engine 10. Further, the second shroud flange 74 in the embodiment shown is located at a radial location generally between the first wing flange 54 and the second wing flange 62 and includes a distal end 75 located adjacent to a wing flange midpoint 69 between the first and second wing flanges 54, 62. A third fluid pocket P3 is formed by the first wing flange 54, the inner shroud 17, and the second shroud flange 74. The first wing flange 54, the first shroud flange 66, and the lip member 68 cooperate to form a labyrinth path in the second fluid pocket P2, extending between the first fluid pocket P1 and the third fluid pocket P3 and indicated by the dashed line 72 in FIG. 2.

The first flexible seal 159 is disposed on a concave side 158 of a first wing flange 154 near a distal end 160 thereof and may be attached to the first wing flange 154, such as by welding. In the embodiment shown, the first flexible seal 159 is formed from a high temperature alloy, such as an INCONEL® alloy, for example, although any suitable material may be used to form the first flexible seal 159 as desired. A thickness of the first flexible seal 159 in the embodiment shown is approximately 0.040 inches (approximately ⅓ of a thickness of the first wing flange 154), although the first flexible seal 159 may have other thicknesses as desired. The first flexible seal 159 may be arcuate shaped to substantially correspond to the arcuate shape of the disc 120 when viewed axially. In the embodiment shown, the first flexible seal 159 is curved in the axial direction and has a concave side 161 facing an axial surface 156 of the inner shroud 117. Also in the embodiment shown, the first flexible seal 159 extends around a distal end 170 of a first shroud flange 166, including a lip member 168.

The second flexible seal 163 is disposed on a convex side 165 of a second wing flange 162, is curved in the radial direction and extends axially toward a radial surface 148 of the inner shroud 117. In the embodiment shown, the second flexible seal 163 is formed from a high temperature alloy, such as an INCONEL® alloy, for example, although any suitable material may be used to form the second flexible seal 163 as desired. A thickness of the second flexible seal 163 in the embodiment shown is approximately 0.040 inches (approximately ⅓ of a thickness of the second wing flange 162), although the second flexible seal 163 may have other thicknesses as desired. The second flexible seal 163 may be arcuate shaped to substantially correspond to the arcuate shape of the disc 120 when viewed axially. In the embodiment shown, the second flexible seal 163 has a convex side 167 facing the axial surface 156 of the inner shroud 117. Also in the embodiment shown, the second flexible seal 163 extends into axially overlapping relationship to an inner surface 173 of a second shroud flange 174. The reduced thickness of the first and second flexible seals 159, 163 relative to the respective first and second wing flanges 164, 162 contributes to flexing movement of the seals 159, 163 in response to a centrifugal force applied during rotation of the disc 120, as is additionally described below.

The first wing flange 154, the first flexible seal 159, the first shroud flange 166, and the lip member 168 of the first shroud flange 166 cooperate to form a first labyrinth path between a gas passage 124 and a disc cavity 126, as indicated by the dashed line 172 in FIG. 3. The first wing flange 154, the second wing flange 162, the second flexible seal 163, and the second shroud flange 174 cooperate to form a second labyrinth path between the gas passage 124 and the disc cavity 126, as indicated by the dotted line 176 in FIG. 3.

It should be noted that the surfaces of the wing member 144, including the surfaces of the first and second wing flanges 154, 162 and the surfaces of the first and second flexible seals 159, 163, may be hardened or coated with a hard material in order to prevent or reduce abrasion and wear of these surfaces in the event that rubbing contact occurs with adjacent stationary surfaces.

The sealing assembly 138 operates in a manner substantially similar to that described for the sealing assembly of the first embodiment. However, the flexible seals 159, 163 operate to further restrict passage of gas, such as cooling air from the disc cavity 126 to the gas passage 124. In particular, rotation of the disc 120, and the resulting centrifugal force applied to the flexible seals 159, 163, causes the flexible seals 159, 163 to move outwardly to locations closely adjacent to the distal end 170 of the first shroud flange 166 and the inner surface 173 of the second shroud flange 174, respectively. Hence, the flexible seals 159, 163 additionally restrict the flow area for the respective labyrinth paths 172, 176. It should also be noted that the flexible seal 163 provides an additional location for causing gas to change direction, i.e., 180 degrees, in order to pass between the disc cavity 126 and the third fluid chamber P3

While FIGS. 1 and 2 illustrate the wing member 44 incorporated into the sides of the discs 20 and FIG. 3 illustrates the wing member 144 extending from the cover plate 147, it should be understood that other configurations for supporting wing members may be provided. For example, wing members may be formed by being cast onto blade platforms and machined to desired specifications. In such a configuration, each blade platform may be provided with a separate wing member. Hence, it should be understood that although particular structure has been illustrated and described for supporting the wing members 44, 144 to extend from the side of the disc 20,120, as defined by either the disc structure itself or elements mounted to the side of the disc structure, other structure or additional structure for supporting the wing members 44, 144 may be provided.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal assembly for limiting gas leakage between a hot gas path and a disc cavity in a turbine engine comprising a plurality of stages, each stage comprising a plurality of stationary components connected by an annular inner shroud and a rotating disc supporting a plurality of blades, the seal assembly comprising:

a wing member extending axially from a side of said disc toward a radial surface of said annular inner shroud, said wing member including an inner side and an outer side;

a first wing flange extending radially outwardly from said outer side of said wing member toward an axial surface of said inner shroud;

a first shroud flange extending radially inwardly from said axial surface of said inner shroud toward said outer side of said wing member to form, with said first wing flange, a labyrinth path between said hot gas path and said disc cavity; and a second shroud flange extending axially from said radial surface of said inner shroud toward said disc and being generally radially aligned with said wing member.

2. The seal assembly of claim 1, wherein said first wing flange extends between said first shroud flange and said radial surface of said inner shroud and includes a distal end located adjacent to said axial surface of said inner shroud.

3. The seal assembly of claim 1, wherein said first shroud flange includes a lip member extending axially from a distal end of said first shroud flange toward said first wing flange.

4. The seal assembly of claim 3, wherein said first wing flange is curved extending in the radial direction, and has a concave side facing said lip member.

5. The seal assembly of claim 3, including a flexible seal disposed on said first wing flange and extending around said distal end of said first shroud flange.

6. The seal assembly of claim 1, including a second wing flange extending radially inwardly from said inner side of said wing member opposite from said first wing flange.

7. The seal assembly of claim 6, wherein said second shroud flange extends axially from said radial surface of said inner shroud toward said disc at a radial location generally between said first wing flange and said second wing flange.

8. The seal assembly of claim 7, including a flexible seal disposed on said second wing flange and extending into axially overlapping relation to a surface of said second shroud flange.

9. The seal assembly of claim 1, wherein said wing member is supported on a cover plate supported on said disc to define said side of said disc.

10. A seal assembly for limiting gas leakage between a hot gas path and a disc cavity in a turbine engine comprising a plurality of stages, each stage comprising a plurality of stationary components connected by an annular inner shroud and a rotating disc supporting a plurality of blades, the seal assembly comprising:

a wing member extending axially from a side of said disc toward a radial surface of said annular inner shroud, said wing member including an inner side and an outer side;

a first wing flange extending radially outwardly from said outer side of said wing member toward an axial surface of said inner shroud;

a second wing flange extending radially inwardly from said inner side of said wing member opposite from said first wing flange;

a first shroud flange extending radially inwardly from said axial surface of said inner shroud toward said outer side of said wing member to form, with said first wing flange, a labyrinth path between said hot gas path and said disc cavity; and a second shroud flange extending axially from said radial surface of said inner shroud toward said disc at a radial location entirely between said first wing flange and said second wing flange.

11. The seal assembly of claim 10, including a first flexible seal disposed on said first wing flange and extending around a distal end of said first shroud flange, and a second flexible seal disposed on said second wing flange and extending into axially overlapping relation to a surface of said second shroud flange.

12. The seal assembly of claim 10, wherein said first wing flange extends between said first shroud flange and said radial surface of said inner shroud, said first wing flange includes a distal end located adjacent to said axial surface of said inner shroud, and said first wing flange is curved extending in the radial direction and has a concave side facing said disc.

13. The seal assembly of claim 10, wherein said wing member is supported on a cover plate supported on said disc to define said side of said disc.

14. The seal assembly of claim 10, wherein said first shroud flange includes a lip member extending axially from a distal end of said first shroud flange toward said first wing flange.

15. A seal assembly for limiting gas leakage between a hot gas path and a disc cavity in a turbine engine comprising a plurality of stages, each stage comprising a plurality of stationary components connected by an annular inner shroud and a rotating disc supporting a plurality of blades, the seal assembly comprising:

a wing member extending axially from a side of said disc toward a radial surface of said annular inner shroud, said wing member including an inner side and an outer side;

a first wing flange extending radially outwardly from said outer side of said wing member toward an axial surface of said inner shroud;

a second wing flange extending radially inwardly from said inner side of said wing member opposite from said first wing flange;

a first shroud flange extending radially inwardly from said axial surface of said inner shroud toward said outer side of said wing member to form, with said first wing flange, a labyrinth path between said hot gas path and said disc cavity;

a second shroud flange extending axially from said radial surface of said inner shroud toward said disc;

a first flexible seal disposed on said first wing flange and extending around a distal end of said first shroud flange; and a second flexible seal disposed on said second wing flange and extending into axially overlapping relation to a surface of said second shroud flange.

16. The seal assembly of claim 15, wherein said second shroud flange is generally radially aligned with said wing member.

17. The seal assembly of claim 15, wherein said second shroud flange extends axially from said radial surface of said inner shroud toward said disc at a radial location generally between said first wing flange and said second wing flange.

18. The seal assembly of claim 15, wherein said first shroud flange includes a lip member extending axially from a distal end of said first shroud flange toward said first wing flange.

19. The seal assembly of claim 18, wherein said first wing flange is curved extending in the radial direction, and has a concave side facing said lip member.

* * * * *